US006151467A

United States Patent [19]

Yamaguchi

[11] Patent Number: 6,151,467

[45] **Date of Patent: *Nov. 21, 2000**

[54] DEVELOPING APPARATUS

[75] Inventor: Seiji Yamaguchi, Numazu, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/060,318

[22] Filed: Apr. 15, 1998

[30] Foreign Application Priority Data

Apr. 16, 1997 [JP] Japan ..... 9-113667

[51] Int. Cl.[7] ..... G03G 15/08

[52] U.S. Cl. ..... 399/104; 399/106

[58] Field of Search ..... 399/104, 103, 399/98, 102, 106

[56] References Cited

U.S. PATENT DOCUMENTS

| | | | |
|---|---|---|---|
| 5,187,326 | 2/1993 | Shirai | 118/657 |
| 5,287,148 | 2/1994 | Sakemi et al. | 399/106 |
| 5,682,585 | 10/1997 | Yamaguichi et al. | 399/274 |
| 5,781,835 | 7/1998 | Okano et al. | 399/275 |
| 5,790,923 | 8/1998 | Oguma et al. | 399/106 |

FOREIGN PATENT DOCUMENTS

| | | |
|---|---|---|
| 608 968 | 8/1994 | European Pat. Off. . |
| 8-137259 | 5/1996 | Japan . |
| 9-43968 | 2/1997 | Japan . |

*Primary Examiner*—Arthur T. Grimley
*Assistant Examiner*—Hoang Ngo
*Attorney, Agent, or Firm*—Fitzpatrick, Cella, Harper and Scinto

[57] ABSTRACT

A developing apparatus includes a developer container, having an opening, for containing a magnetic developer; developer carrying member, provided in the opening, for carrying a developer, the developer carrying member having therein magnetic field generating means for carrying the magnetic developer; a sealing magnet for forming a magnetic seal for preventing leakage of the developer at an end portion, wherein an outer end portion of the sealing magnet with respect to a longitudinal direction of the developer carrying member is disposed in a region where a magnetic flux density at a surface of the developer carrying member attenuates.

6 Claims, 4 Drawing Sheets

DEVELOPING APPARATUS

FIELD OF THE INVENTION AND RELATED ART

The present invention relates to a developing apparatus which is employed in an image forming apparatus such as a copying machine, a printer, or the like, to develop an electrostatic image on an image bearing member.

FIG. 4 shows a typical developing apparatus 100. The developing apparatus 100 comprises a developer container 101, a stirring member 102, a development sleeve 103 as a developer bearer in the form of a roller, a development blade 105, and a magnetic sealing member 106 which prevents magnetic developer T (hereinafter, "magnetic toner T") from leaking out of the developer container 101.

The developer container 101 of the developing apparatus 100 can hold a predetermined amount of the magnetic toner T. As the stirring member 102, which is supported by the developer container 101 by its axis portion, rotates in the direction of an arrow mark in the drawing, the magnetic toner T is mechanically stirred, so that the aggregated particles of the magnetic toner T are separated into independent particles which can be smoothly borne on the development sleeve 103.

The development sleeve 103 of the developing apparatus 100 is rotatively supported by the bearings (unillustrated) integral with the developer container 101, by its axis. In the internal space of the developer container 101, a magnetic roller 101 is fixedly disposed, coaxially with the development sleeve 103. The peripheral surface of the magnetic roller 104 is provided with a plurality of magnetic poles (N1, S1, N2, and S2), which are symmetrically arranged about the rotational axis of the magnetic roller 104.

Thus, the development sleeve 103 is caused to bear the developer and smoothly deliver it to an image bearing member, by the magnetic forces generated by the magnetic poles N1, S1, N2, and S2.

The magnetic roller 104 within the development sleeve 103 has been magnetized in such a manner that when the development sleeve 103 is divided into two halves by a plane which contains the axial line of the development sleeve 103, the two halves become symmetrical with respect to the plane, in terms of magnetism.

The development blade 105 of the development apparatus 100 is positioned a predetermined distance away from the peripheral surface of the development sleeve 103, to make uniform the thickness of the layer of the magnetic toner T borne on the peripheral surface of the development sleeve 103.

The magnetic sealing member 106 of the developing apparatus 100 is located at each longitudinal end of the development sleeve 103. The shape of the magnetic sealing member 106 is such that when it is assembled into the developing apparatus, its surface, which faces the peripheral surface of the development sleeve 103, wraps halfway around the development sleeve, that is, follows the curvature of the peripheral surface of the development sleeve 103, holding a predetermined gap, to prevent the magnetic toner T from leaking through a gap Sp between the development sleeve 103 and the magnetic sealing member 106 (hereinafter, this function will be referred to as "sealing").

In the past, elastic seals composed of elastic material such as felt or rubber have been used as the means for sealing the developing apparatus 100. More specifically, in the sealing systems which employ an elastic seal, the elastic seal is fitted in the gap Sp between the peripheral surface of the development sleeve 103 and the wall of the developer container 101, at each longitudinal end of the development sleeve 103.

However, these systems suffer from a problem. That is, in the image forming apparatuses which employed one of these systems, the driving torque delivered to the development sleeve 103 was affected by the friction caused by the elastic seal. As a result, the peripheral velocity of the development sleeve 103 became irregular, which caused the development sleeve 103 to lose the ability to bear the developer in a layer of uniform thickness. In other words, the developer was unevenly borne on the peripheral surface of the development sleeve 103. The uneven layer of developer formed a toner image, the toner density of which did not accurately reflect the image formation data such as the image data of a target image or the like. Consequently, a low quality image was formed on a sheet of recording medium, for example, a sheet of recording paper.

Thus, in recent years, new types of sealing systems which employ a magnetic sealing member 106 have been proposed as sealing means for the development apparatus 100, which can prevent the above described degradation of image quality associated with the sealing systems. Further, some of the proposals have already been put to practical use.

The magnetic sealing member 106 is magnetized to generate a magnetic field which has a predetermined pattern such as the one illustrated in FIG. 5, so that it creates, in coordination with the magnetic roller 104, a magnetic field which has a pattern such as the one illustrated in FIG. 6.

Being magnetized to generate the magnetic field illustrated in FIG. 6, the magnetic sealing member 106 causes toner particles to pile up in the direction of the magnetic flux illustrated in FIG. 6, in the form of ears of wheat (like the tip of a paint brush), in the gap Sp; the magnetic sealing member 106 causes toner particles to pile up and fill the gap Sp so that they act as an agent for sealing the gap Sp.

Thus, in order for the magnetic sealing member 106 described above to effectively seal the gap Sp, it is indispensable that the density of the magnetic flux in the gap Sp between the peripheral surface of the development sleeve 103 and the magnetic sealing member is high enough to pile up in the gap Sp a sufficient amount of toner particles as the sealing agent.

More specifically, when the magnetic sealing member 106, disposed in a manner to wrap around the peripheral surface of the development sleeve 103 at each end of the development sleeve 103, was in the region in which the magnetic force of the magnetic roller 104 was relatively weak at the peripheral surface of the development sleeve 103, the magnetic flux density between the magnetic sealing member 106 and the development sleeve 103 became relatively low (number of the lines representing the magnetic flux in the gap Sp became small). Therefore, a magnetic brush, which was capable of satisfactorily sealing the developer container 101, was not likely to be formed in the aforementioned gap Sp.

On the other hand, when the magnetic sealing member 106, disposed in a manner to wrap around the peripheral surface of the development sleeve 103 at each longitudinal end of the development sleeve 103, was in the region in which the magnetic force of the magnetic roller 104 was strong at the peripheral surface of the development sleeve 103, the distribution of the magnetic flux density between the magnetic sealing member 106 and the development sleeve 103 was greatly affected by the magnetic force of the magnetic roller 104. As a result, the area with highly dense magnetic flux extends as far as the region on the outward side of the magnetic sealing member 106. Consequently, the magnetic toner T borne on the peripheral surface of the development sleeve 103 was likely to be easily moved in the direction of the highly dense magnetic flux, into the region on the outward side of the magnetic sealing member 106. In other words, the magnetic sealing member 106 was likely to fail to seal the developer container 101.

SUMMARY OF THE INVENTION

An object of the present invention is to provide a developing apparatus, from the lateral end of which developer is prevented from leaking.

Another object of the present invention is to provide a developing apparatus which is sealed by confining magnetic developer with the use of magnetic force.

These and other objects, features and advantages of the present invention will become more apparent upon a consideration of the following description of the preferred embodiments of the present invention, taken in conjunction with the accompanying drawings.

DESCRIPTION OF THE PREFERRED EMBODIMENTS

Hereinafter, an embodiment of the present invention will be described with reference to the drawings.

Figure 1:
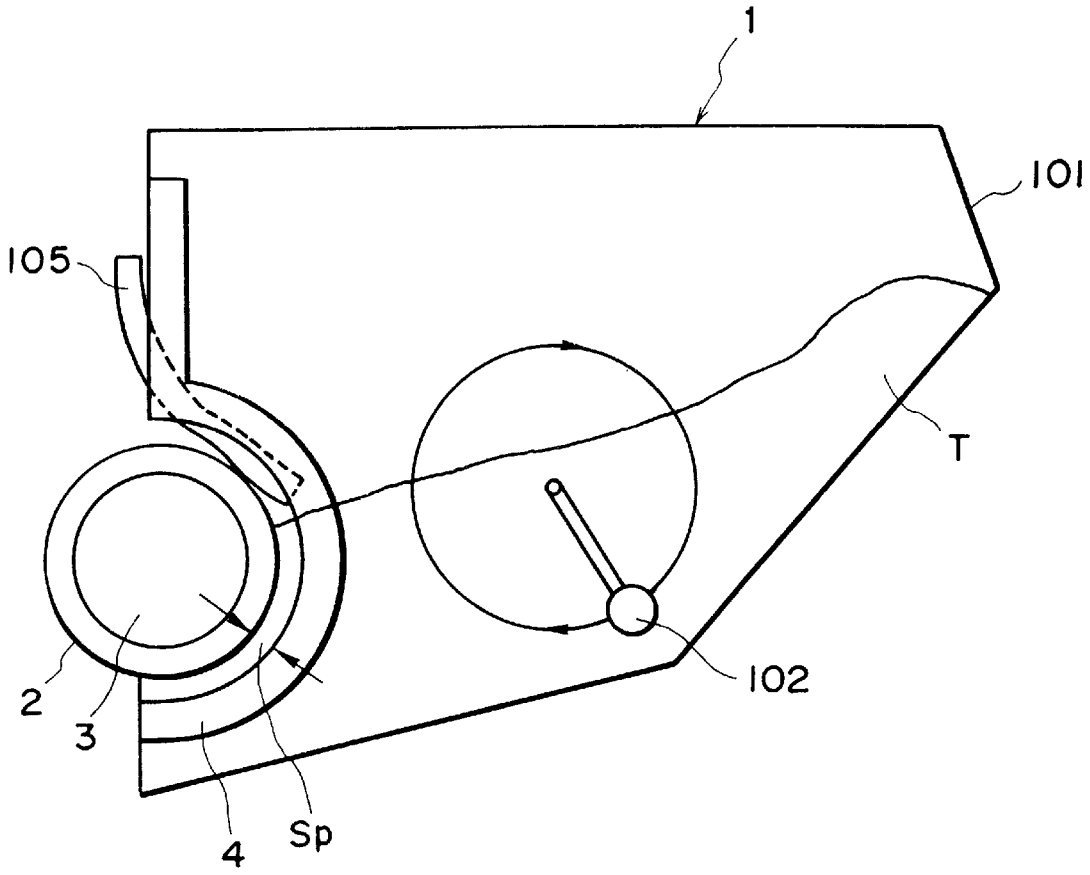
FIG. 1 is a schematic section of a typical developing apparatus, to which the present invention is applicable, depicting the general structure of the portion of the apparatus essential to describe the present invention.
Figure 2:
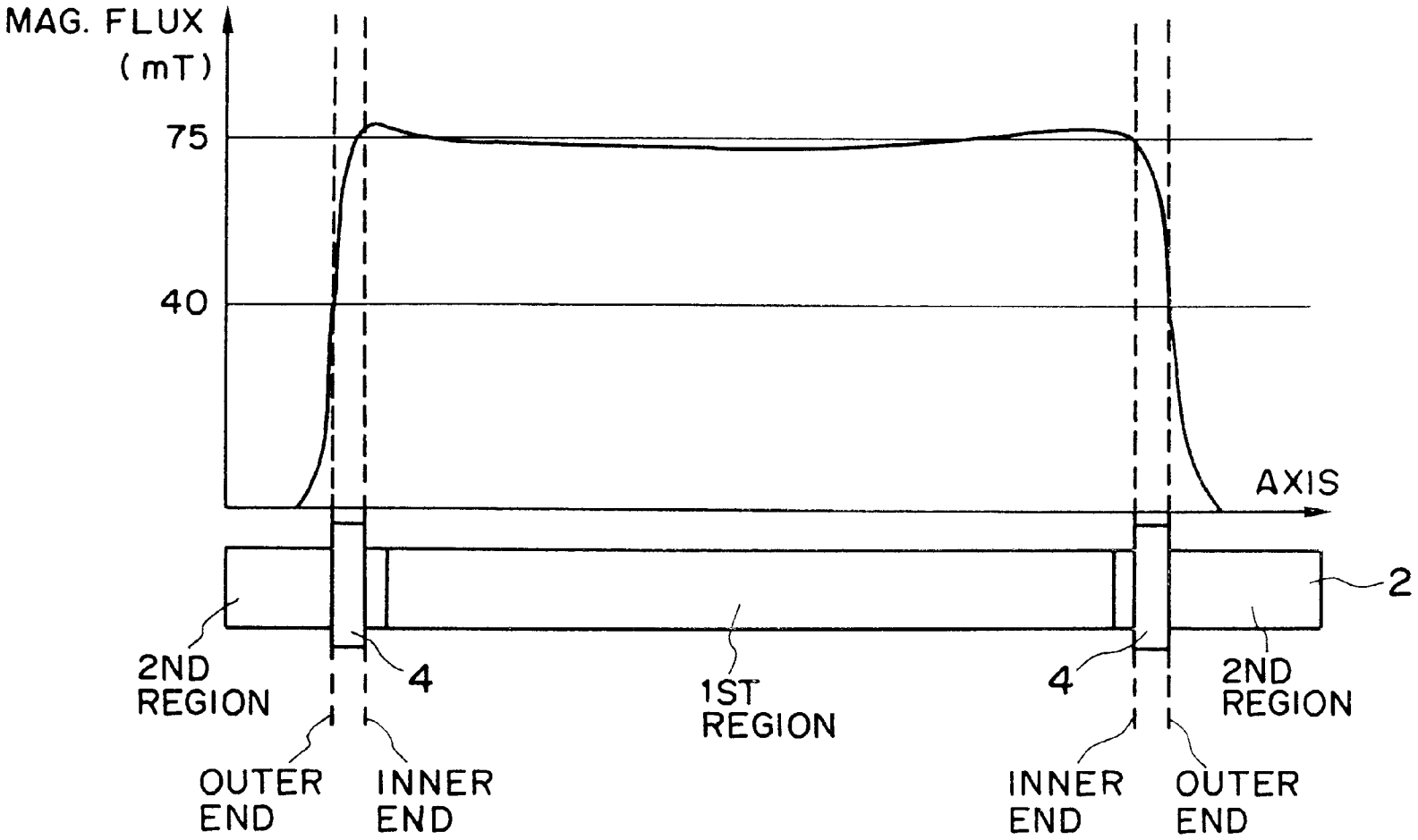
FIG. 2 is a map of the magnetic flux density in the axial direction of the development sleeve, superposed on a schematic plan view of the development sleeve of the developing apparatus illustrated in FIG. 1, and the adjacencies thereof.
Figure 3:
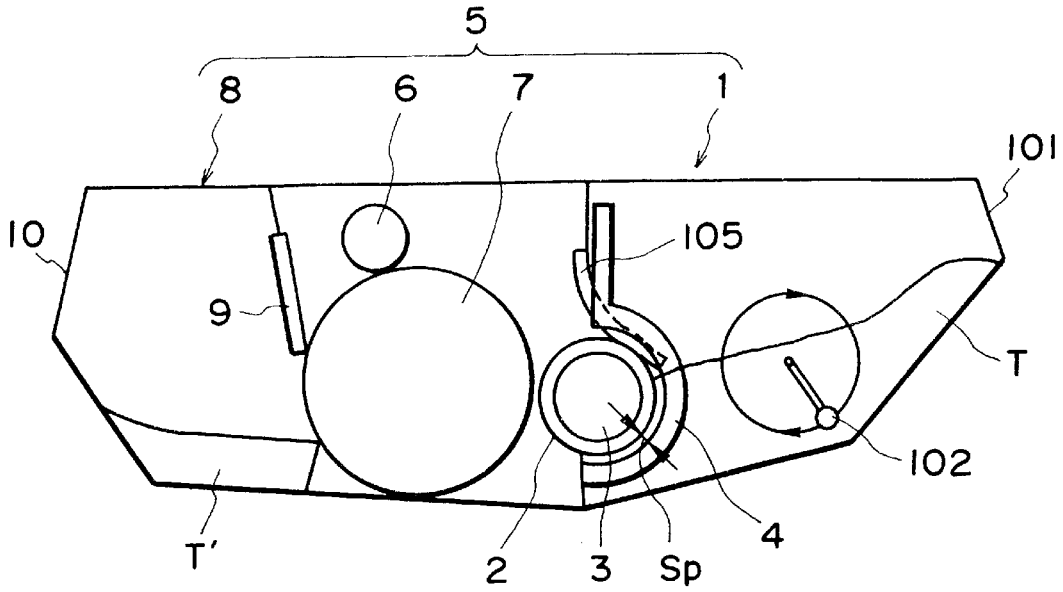
FIG. 3 is a schematic section of a process cartridge which comprises the developing apparatus illustrated in FIG. 1, depicting the general structure thereof.
Figure 4:
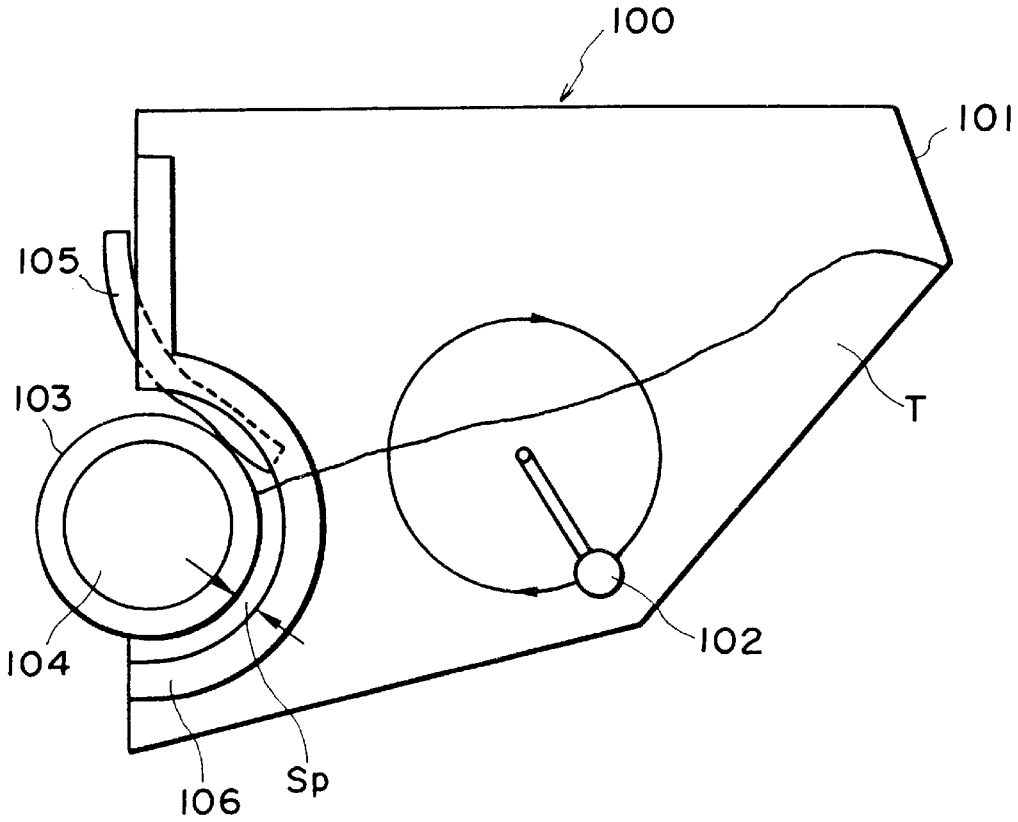
FIG. 4 is a schematic section of a developing apparatus, depicting the general structure thereof.

FIGS. 1 and 2 depict the developing apparatus in accordance with the present invention. FIG. 1 is a schematic section of the developing apparatus, and FIG. 2 is a map of the magnetic flux density at the peripheral surface of the developing sleeve, superposed on the schematic plan view of the development sleeve and the adjacencies thereof. In FIGS. 1 and 2, components corresponding to those in FIG. 4 are designated with the same reference characters as those in FIG. 4, so that repetition of the same description can be avoided.

Referring to FIG. 1, a developing apparatus 1 comprises a developer container 101 for holding magnetic toner, a stirring member 102, a development sleeve 2 as a developer bearer, a development blade 105, and a magnetic sealing member 4.

The development sleeve 2 of the developing apparatus 1 is composed of aluminum, and is in the form of a roller with an external diameter of 16 mm. It is rotatively supported by the bearings (unillustrated) integral with the developer container 101, by its rotational axis.

As the development sleeve rotates, it bears a layer of the magnetic toner T, that is, the magnetic developer, and carries it to the development blade 105, which is disposed a predetermined distance from the peripheral surface of the development sleeve 2. As the layer of the magnetic toner T borne on the development sleeve 2 comes in contact with the development blade 105, the thickness of the magnetic toner T layer is adjusted to a thickness within a proper range.

In the space within the cylindrical development sleeve 2, a magnetic roller 3 is fixedly disposed, concentrically with the development sleeve 2. This magnetic roller 3 has been magnetized so that a plurality of magnetic poles (N1, S1, N2, and S2), which extend in the longitudinal direction of the magnetic roller 3, are positioned at the peripheral surfaces the magnetic roller 3, in symmetry with respect to the rotational axis of the magnetic roller 3.

The magnetic sealing member 4 in this embodiment is composed of magnetic particles, which are composed of Nd, Fe, and B, and nylon binder. It is formed by injection-molding, and is approximately 3 mm wide in the direction of the normal line thereof in FIG. 1.

The gap between the magnetic sealing member 4 and the development sleeve 2 is set at approximately 0.5 mm so that, within the region in which the peripheral surface of the development sleeve 2 squarely faces the magnetic sealing member 4, the magnetic flux density at the peripheral surface of the development sleeve 2 becomes 100–200 mT.

The magnetic poles S1 and S2 of the magnetic roller 3 are responsible for causing the magnetic toner T to be borne on the development sleeve 2; the magnetic forces from the magnetic poles S1 and S2 attract the magnetic toner T onto the peripheral surface of the development sleeve 2. On the other hand, the magnetic poles N1 and N2 are responsible for causing the magnetic toner T borne on the development sleeve 2 to be smoothly carried to an image bearing member (unillustrated).

Generally, in the case of a development sleeve on which the magnetic toner T is held with the use of magnetic force, the strength of the magnetic field at the peripheral surface of the development sleeve must be uniform, or substantially uniform, in the axial direction of the development sleeve. Otherwise, the amount of the magnetic toner T held on the development sleeve becomes different in terms of the axial direction of the development sleeve, which makes it impossible for the electrostatic latent image formed on the image bearing member to be uniformly developed in terms of the axial direction; the toner particles are likely to be adhered to the peripheral surface of the image bearing member in such a manner that does not accurately reflect the pattern of the latent image.

Referring to FIG. 2, the positional relationship between the magnetic sealing member 4 and the magnetic roller 3 is set up in such a manner that in a first region which is the region between the two magnetic sealing members 4 and 4, the magnetic flux density at the peripheral surface of the development sleeve 2 becomes substantially uniform across the region, but in the second regions which are the regions outside the first region, the magnetic flux density at the peripheral surface of the development sleeve 2 reduces from the level within the first region, as the distance from the first region toward the longitudinal end of the development sleeve 2 increases.

The reason for such a positional setup is as follows.

With the above described positional setup between the magnetic sealing members 4 and the development sleeve 2, the magnetic sealing members 4 are positioned in the region where the magnetic flux density reduces as the distance from the inward surface of the magnetic sealing members 4 toward the outward surface of the magnetic sealing members 4 increases; in other words, the magnetic flux density is higher (number of the lines representing the magnetic flux is larger) on the inward side of the sealing members 4 than on the outward side of the sealing members 4, that is, the magnetic force which causes the magnetic toner T to stay on the peripheral surface of the development sleeve 2 is greater on the inward side of the magnetic sealing member than on the outward side of the magnetic sealing members 4. Therefore, the magnetic toner T is effectively sealed; it is not drawn outward with the rotation of the development sleeve 2 rotates.

It should be noted here that the aforementioned region in which the magnetic flux density reduces as the outward distance from the inward surface of the magnetic sealing members 4 increases does not include the region in which decrease in the magnetic flux density is detectable only in macroscopic terms; it includes only the region in which the decrease in the magnetic flux density is drastic as illustrated in FIG. 2.

More specifically, in this embodiment, the positional relationship between the magnetic sealing members 4, and the magnetic roller 3 is set so that the magnetic flux density at the peripheral surface of the development sleeve 2 becomes as low as 40 mT on the outward side of the magnetic sealing members 4. However, the magnetic flux density at the outward surface of the magnetic sealing members 4 does not necessarily have to be as low as 40 mT. In other words, it has only to be not high enough to move the magnetic toner T from the first region to the second region; as long as the magnetic flux density at the inward surface of the magnetic sealing members 4 is no more than 50 mT, it is substantially guaranteed that the objective of the present invention can be accomplished.

In this embodiment, the magnetic flux density map is such that in the first region, the magnetic flux density is approximately 75 mT across the magnetic pole S2 which extends on the peripheral surface of the magnetic roller 3 in the axial direction of the magnetic roller 3, and in the second region, the magnetic flux density drops from 75 mT as the distance from the magnetic sealing members 4 toward the longitudinal end of the development sleeve 2 increases. In fact, the magnetic flux density at the peripheral surface of the development sleeve 2 is set at 40 mT at the outside surface of the magnetic sealing members 4.

Thus, in the first region between the two magnetic sealing members 4, the development sleeve 2 is enabled to evenly bear the magnetic toner T across the entire region, since the magnetic flux density at the peripheral surface of the development sleeve 2 is rendered uniform, or substantially uniform, in the first region as described above.

Further, the magnetic sealing members 4 can be placed closer to the development region than they could prior to the present invention. Therefore, the length of the development sleeve 2 can be reduced.

Figure 5:
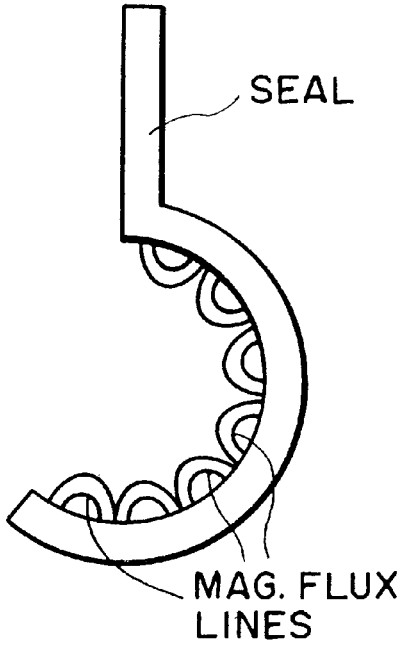
FIG. 5 is a schematic drawing which depicts the profile of the magnetic sealing member of the developing apparatus illustrated in FIG. 4, and a typical pattern of the magnetic field formed, in coordination with the magnetic sealing member, by the magnetic sealing member of the developing apparatus.
Figure 6:
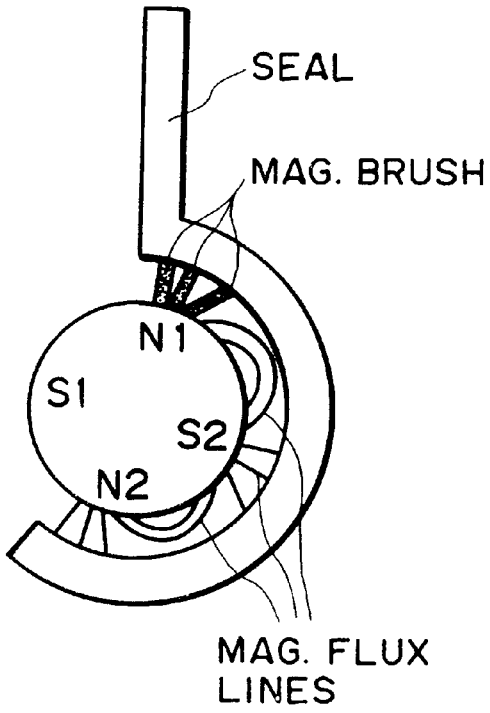
FIG. 6 is a schematic drawing which depicts the pattern of the magnetic field formed by the interaction of the magnetic roller and the magnetic sealing member.

Next, referring to FIG. 5, a process cartridge 5 in which the developing apparatus 1 in the first embodiment of the present invention is to be employed will be described.

In the process cartridge 5, the developing apparatus 1, a rotative photosensitive drum 7 as an image bearing member, a rotative charge roller 6 as a means for preparing the photosensitive drum 7 for image formation by giving it primary charge, a cleaning apparatus 8 as a means for preparing the photosensitive drum 7 for image formation by cleaning it, are integrally disposed so that they can be removably installed in the main assembly of an image forming apparatus (unillustrated) in which they are used for image formation.

The primary charge roller 6 uniformly charges the peripheral surface of the photosensitive drum 7 to a predetermined potential level, preparing it for the formation of an electrophotographic latent image; the uniformly charged peripheral surface of the photosensitive drum 7 is exposed to a beam of light modulated with signals which reflect the optical data of a target image, and as a result, an electrostatic latent image is formed on the peripheral surface of the photosensitive drum 7.

The photosensitive drum 7 is rotated in the clockwise direction in synchronism with the development sleeve 2, so that the latent image borne thereon is developed with the use of the magnetic toner T.

The cleaning apparatus 8 is such an apparatus that prepares the photosensitive drum 7 for the following image formation cycle by removing the waste toner T', that is, the toner T which is remaining on the photosensitive drum 7 after toner image transfer. It comprises a cleaning blade 9 and a waste toner container 10.

More specifically, the cleaning blade 9 of the cleaning apparatus 8 is placed in contact with the peripheral surface of the photosensitive drum 7, and the waste toner T' is scraped into the waste toner container 10 by the cleaning blade 9, preparing the photosensitive drum 7 for the following image formation cycle.

With the use of the process cartridge 5, not only can the effects described in the first embodiment of the present invention be enjoyed, but also, the developing apparatus 1, the primary charge roller 6, the photosensitive drum 7, and the cleaning apparatus 8 can be easily and quickly checked, repaired, or, if necessary, replaced. Further, it does not occur that the components around the toner container 101 or the waste toner container 10 are soiled when the developing apparatus is replenished with the magnetic toner T, or when the waste toner T' collected in the waste toner container 10 is disposed. Thus, the users of the image forming apparatus which employs the developing apparatus and the process cartridge in accordance with the present invention can continuously produce high quality images for a long period of time.

While the invention has been described with reference to the structures disclosed herein, it is not confined to the details set forth, and this application is intended to cover such modifications or changes as may come within the purposes of the improvements or the scope of the following claims.

What is claimed is:

1. A developing apparatus comprising:

a developer container, having an opening, for containing a magnetic developer;

a developer carrying member, provided in the opening, for carrying a developer, said developer carrying member having therein a magnetic field generating means for generating a magnetic field for carrying the magnetic developer on said developer carrying member;

a sealing magnet for forming a magnetic seal for preventing leakage of the developer at an end portion, wherein magnetic flux densities generated by said magnetic field generating means at a surface of said developer carrying member are substantially the same adjacent a central position, in a longitudinal direction of said developer carrying member, of said magnetic field generating means and adjacent a position of an inner end portion of said sealing magnet, and decrease from the position of said inner end portion toward a position of an outer end portion of said sealing magnet.

2. An apparatus according to claim 1, wherein a magnetic flux density provided by said magnetic field generating means at the surface of said developer carrying member at a position opposed to the outer end portion of said sealing magnet is not more than 50 mT.

3. An apparatus according to claim 1, wherein said sealing magnet is provided at each of opposite ends of said developer carrying member, and a magnetic flux density at the surface of said developer carrying member is substantially constant between said sealing magnets.

4. An apparatus according to claim 1, wherein said sealing magnet has a plurality of magnetic poles disposed along a circumference of said developer carrying member.

5. An apparatus according to claim 1, wherein the developer is a magnetic toner.

6. An apparatus according to claim 1, wherein said developing apparatus constitutes a process cartridge which is detachably mountable relative to an image forming apparatus as a unit including an image bearing member for bearing an electrostatic image.

* * * * *